US009810066B2

(12) United States Patent
Westphalen et al.

(10) Patent No.: US 9,810,066 B2
(45) Date of Patent: Nov. 7, 2017

(54) CONTROL METHOD FOR LONGWALL SHEARER

(71) Applicant: Caterpillar Global Mining Europe GmbH, Lünen (DE)

(72) Inventors: Andreas Johannes Westphalen, Duisburg (DE); Euan Kirkhope, Cameron Park (AU); Siddartha Saikia, Chennai (IN); Hrishikesh Ranjalkar, Bangalore (IN)

(73) Assignee: Caterpillar Global Mining Europe GmbH, Lunen (DE)

( * ) Notice: Subject to any disclaimer, the term of this patent is extended or adjusted under 35 U.S.C. 154(b) by 8 days.

(21) Appl. No.: 14/889,336

(22) PCT Filed: May 9, 2014

(86) PCT No.: PCT/EP2014/001250
§ 371 (c)(1),
(2) Date: Nov. 5, 2015

(87) PCT Pub. No.: WO2014/183854
PCT Pub. Date: Nov. 20, 2014

(65) Prior Publication Data

US 2016/0123145 A1 May 5, 2016

(30) Foreign Application Priority Data

May 13, 2013 (EP) ..... 13167547

(51) Int. Cl.
*E21C 35/24* (2006.01)
*E21C 35/12* (2006.01)
(Continued)

(52) U.S. Cl.
CPC ..... *E21C 35/24* (2013.01); *E21C 25/10* (2013.01); *E21C 27/32* (2013.01); *E21C 29/02* (2013.01); *E21C 35/08* (2013.01); *E21C 35/12* (2013.01)

(58) Field of Classification Search
CPC ..... E21C 35/24; E21C 35/08; E21C 35/12; E21C 35/125; E21C 29/02; E21C 31/08
See application file for complete search history.

(56) References Cited

U.S. PATENT DOCUMENTS 4,008,921 A * 2/1977 Czauderna ..... E21C 35/08 299/1.1
4,634,186 A 1/1987 Pease
(Continued)

FOREIGN PATENT DOCUMENTS

CN 1396982 2/2003
DE 10 2009 026 011 A1 12/2010
(Continued)

OTHER PUBLICATIONS

International Search Report dated Jun. 22, 2015, in Patent Application No. PCT/EP2014/001250 by the European Patent Office (3 pages).
(Continued)

*Primary Examiner* — John Kreck
*Assistant Examiner* — Michael Goodwin

(57) ABSTRACT

A method of controlling a shearer is disclosed. The shearer may be configured to travel along a longwall face to extract material with a first cutting drum and a second cutting drum. The method may include setting a first cutting profile including a plurality of desired positions (Di) to be approached by the first cutting drum in a first travel direction (E). Further, the method may include determining a plurality of actual advancing vectors (vi) indicating a change of a position of the shearer resulting from advancing the shearer
(Continued)

towards the longwall face. The method may also include determining a plurality of shearer orientations (Oi) along the longwall face. In addition, the method may include generating a second cutting profile to be approached by at least one of the first cutting drum and the second cutting drum in a second travel direction (F) of the shearer.

19 Claims, 7 Drawing Sheets

(51) Int. Cl.

| | |
|---|---|
| ***E21C 29/02*** | (2006.01) |
| ***E21C 27/32*** | (2006.01) |
| ***E21C 25/10*** | (2006.01) |
| ***E21C 35/08*** | (2006.01) |

(56) References Cited

U.S. PATENT DOCUMENTS

| | | | | |
|---|---|---|---|---|
| 4,643,482 | A | 2/1987 | Wolfenden | |
| 4,822,105 | A | 4/1989 | Yamada et al. | |
| 5,228,751 | A * | 7/1993 | Ramsden, Jr. | E21C 35/24 299/1.6 |
| 6,179,386 | B1 * | 1/2001 | Meya | E21C 35/12 299/43 |
| 2003/0075970 | A1 | 4/2003 | Hainsworth et al. | |
| 2011/0006584 | A1 * | 1/2011 | Junker | E21C 35/14 299/1.3 |
| 2011/0049964 | A1 * | 3/2011 | Junker | E21C 35/12 299/1.7 |
| 2012/0161493 | A1 * | 6/2012 | Junker | E21C 35/24 299/1.1 |

FOREIGN PATENT DOCUMENTS

| | | |
|---|---|---|
| EP | 1 276 969 B1 | 12/2006 |
| GB | 2 254 869 | 10/1992 |

OTHER PUBLICATIONS

European Search Report dated Nov. 1, 2013, in Patent Application No. EP 13 16 7547 (2 pages).

* cited by examiner

CONTROL METHOD FOR LONGWALL SHEARER

CLAIM FOR PRIORITY

This application is a U.S. National Phase entry under 35 U.S.C. §371 from PCT International Application No. PCT/EP2014/001250, filed May 9, 2014, which claims benefit of priority of European Patent Application No. 13167547.2, filed May 13, 2013, all of which are incorporated herein by reference.

TECHNICAL FIELD

The present disclosure generally relates to a method for controlling a shearer, and more particularly to a method for controlling a shearer along a longwall face in an underground mine.

BACKGROUND

For the purpose of extracting material along a longwall face in an underground mine, a shearer with two cutting drums may be provided. As is known per se, the shearer reciprocates along the longwall face to extract material with the two rotating cutting drums. Extracted material is dropped onto a face conveyor extending along the longwall face to transport the extracted material to a roadway for further processing.

Control of the shearer typically requires operator assistance, for example, to guide the cutting drums in accordance with the material seam to be extracted. As an underground mine is a tough and hazardous environment not only for the mining equipment, but also for the mining equipment operators, providing methods for controlling the shearer along the longwall face, which require reduced operator assistances, are subject of ongoing interest of mining equipment manufacturers.

For example, EP 1 276 969 B1 discloses a mining machine which moves from side-to-side in sequential passes across a seam of material to be mined. The machine is carried on rail means and coordinate positions of the rail means are measured at locations along the length of the rail means. A trailing part of the rail means is then moved by rail moving means to a new position for a next pass, and the distance of moving is determined from the co-ordinates of the positions previously measured. Coordinates of the up and down movement of a shearing head can also be measured and stored to provide a profile of the seam being cut, and so that on a next pass the intended position of the shearing head can be predicted and moved accordingly.

As a further example, U.S. Pat. No. 4,822,105 A discloses mining methods for a shearer. An operator manually manages or handles the drums during half of an operation cycle, and heights of respective right and left drums at respective travelling positions and inclined angles of a shearer body are stored in a teaching mode. The next half-cycle operation can be achieved by a playback operation mode. Thereby, a constant working height of a mining face under controlled condition is maintained.

As yet another example, US 2003/0075970 A1 discloses a mining machine that moves from side-to-side in sequential passes across a material seam to be mined. The machine is carried on rail means, and co-ordinate positions of the rail means are measured at locations along the length of the rail means. A trailing part of the rail means is moved to a new position for a next pass. The distance of moving is determined from previously measured positions to assume a desired profile, preferably a straight line.

The present disclosure is directed, at least in part, to improving or overcoming one or more aspects of prior systems.

SUMMARY OF THE DISCLOSURE

According to a first aspect of the present disclosure, a method for controlling a shearer is disclosed. The shearer may be configured to travel along a longwall face in an underground mine in a first travel direction and a second travel direction opposing the first travel direction to extract material with a first cutting drum and a second cutting drum. The method may comprise setting a first cutting profile including a plurality of desired positions to be approached by the first cutting drum in the first travel direction, advancing the shearer towards the longwall face, determining a plurality of actual advancing vectors along the longwall face, each actual advancing vector indicating a change of a position of the shearer resulting from advancing the shearer, determining a plurality of shearer orientations along the longwall face resulting from advancing the shearer, and generating a second cutting profile including a plurality of desired positions to be approached by at least one of the first cutting drum and the second cutting drum in the second travel direction of the shearer based on the set first cutting profile, the plurality of actual advancing vectors, and the plurality of shearer orientations.

According to another aspect of the present disclosure, a shearer configured to be carried by a face conveyor extending along a longwall face in an underground mine is disclosed. The shearer may comprise a main body having a first end and a second end opposing the first end, a first cutting drum pivotably mounted to the first end of the main body to vary a cutting drum height of the first cutting drum, a second cutting drum pivotably mounted to the second end of the main body to vary a cutting drum height of the second cutting drum, a position and orientation measuring device configured to measure a position and an orientation of the shearer, and a control unit configured to implement a method as exemplary disclosed herein to generate a second cutting profile based on information received from the position and orientation measuring device to control a cutting drum height of the first cutting drum and/or a cutting drum height of the second cutting drum.

Other features and aspects of this disclosure will be apparent from the following description and the accompanying drawings.

DETAILED DESCRIPTION

Figure 1:
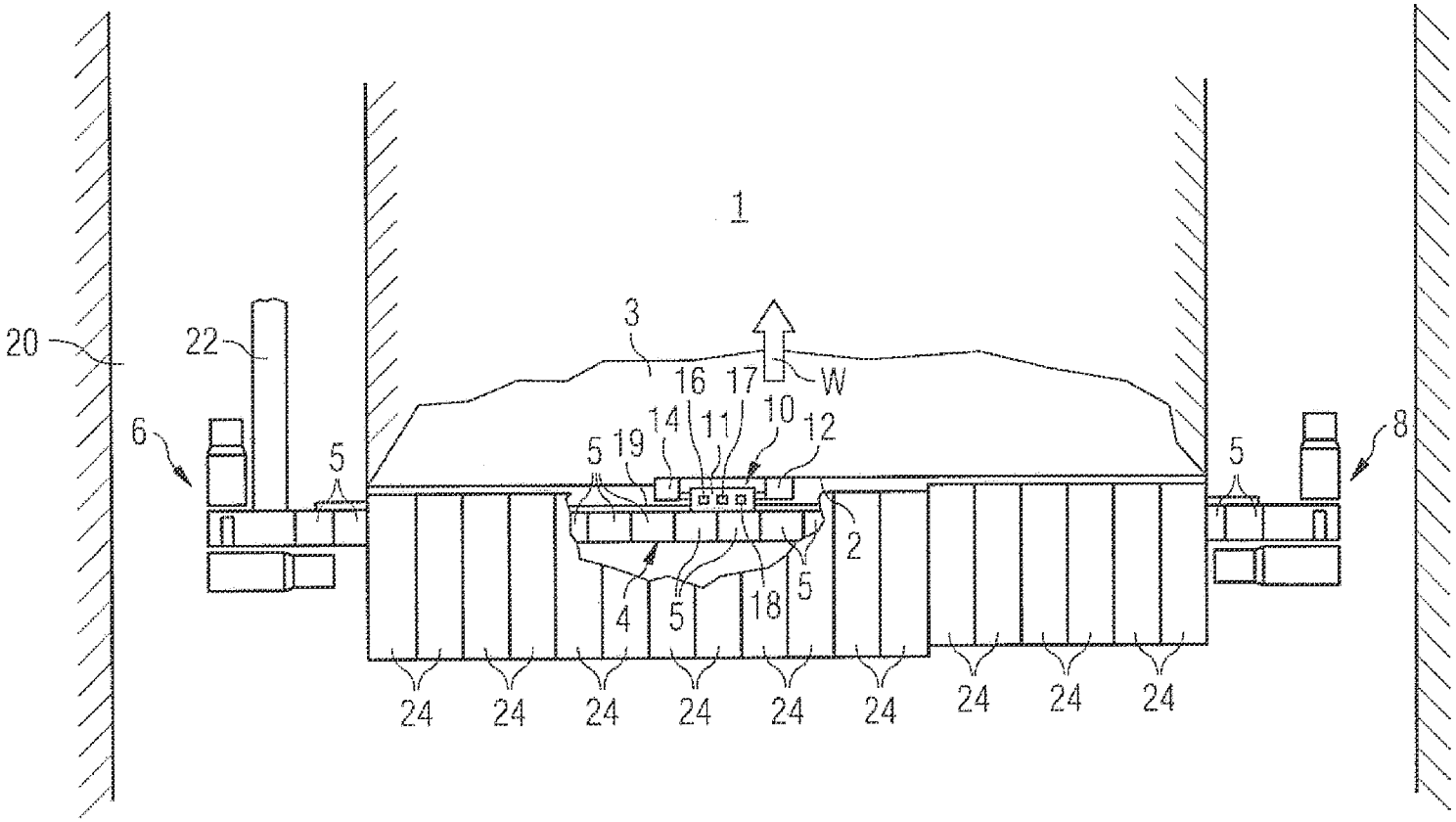
FIG. 1 is a schematic drawing of an underground mine with a longwall face.

The following is a detailed description of exemplary embodiments of the present disclosure. The exemplary embodiments described therein and illustrated in the drawings are intended to teach the principles of the present disclosure, enabling those of ordinary skill in the art to implement and use the present disclosure in many different environments and for many different applications. Therefore, the exemplary embodiments are not intended to be, and should not be considered as, a limiting description of the scope of patent protection. Rather, the scope of patent protection shall be defined by the appended claims.

The present disclosure is based in part on the realization that methods for controlling a shearer in an underground mine require a considerable amount of operator assistance due to unavailability and incompleteness of automated control methods. As the underground mine is a tough and hazardous environment bearing a plurality of risks for operators such as methane gas explosions, it is desirable to reduce the required underground operator assistance.

Accordingly, a method for controlling a shearer which reduces required operator assistance is disclosed. The method facilitates generation of cutting profiles used to control cutting drums of a shearer. Particularly, after setting an initial cutting profile in one travel direction of the shearer along a longwall face, the exemplary disclosed method generates a further cutting profile for a reverse travel of the shearer along the longwall face. The generated cutting profile incorporates a plurality of measured input parameters to facilitate compensation of varying bottom floor constitutions.

An exemplary underground mine 1 is shown in FIG. 1. For the purpose of extracting material along a longwall face 2, underground mine 1 comprises a face conveyor 4 with a main drive 6 and an auxiliary drive 8, and a shearer 10 carried by face conveyor 4. Specifically, shearer 10 is guided via a shearer guiding rail 19 attached to face conveyor 4 facing longwall face 2.

Face conveyor 4 extends along longwall face 2 and comprises a plurality of face conveyor segments 5. Adjacent face conveyor segments 5 are connected to one another, for example, so as to resist separation when a tensile force is applied and so as to restrict relative angular movement. Face conveyor segments 5 are arranged in a row between two stations, which respectively accommodate sprockets and use the sprockets to redirect an endless conveyor of face conveyor 4 to transport extracted material dropped onto face conveyor 4.

In operation, shearer 10 cuts along longwall face 2 in a reciprocating manner to extract material 3, for example, coal. To cut material, shearer 10 comprises a first cutting drum 12 and a second cutting drum 14, both being equipped with a plurality of cutting tools. Material mined by shearer 10 drops onto face conveyor 4 which transports the extracted pieces of rock and minerals to a main roadway 20 (also referred to as drift). There, the extracted pieces are passed to a pass-over conveyor or roadway conveyor 22. The transported pieces may be crushed and further transported via, for example, a belt conveyor.

Shearer 10 is further equipped with an inclinometer 16 and an inertial measurement device 18. Alternatively, shearer 10 may be equipped with additional position and orientation measuring devices, and/or may either comprise inclinometer 16 or inertial measurement device 18.

Shearer 10 further comprises a main body 11 with a first end and a second end opposing the first end. First cutting drum 12 is pivotably mounted to the first end of main body 11 via a ranging arm (not shown) to vary a cutting drum height of first cutting drum 12. Similarly, second cutting drum 14 is pivotably mounted to the second end of main body 11 to vary a cutting drum height of second cutting drum 14 via another ranging arm (not shown). To generate cutting profiles as described hereinafter, shearer 10 may further comprise a control unit 17. Control unit 17 may receive information from the position and orientation measuring device(s), for example, inclinometer 16 and/or inertial measurement device 18 to control a cutting drum height of first cutting drum 12 and/or a cutting drum height of second cutting drum 14.

To maintain longwall face 2 accessible, a plurality of shield supports 24 is arranged along longwall face 2. At each shield support 24, a moving device (not shown) is supported, which can consist of in each case one pushing or walking bar, which can be loaded hydraulically in both directions in order to push a face conveyor segment 5 of face conveyor 4 optionally and section by section in the work direction (arrow W) or pull up individual shield supports 24 in the work direction (arrow W) to follow longwall face 2 which moves on and on in work direction (arrow W) as shearer 10 continues to extract material 3. Longwall face 2 is further kept open by shield caps forming an upper unit of each shield support 24. Surrounding rock can only break in and form the so-called old workings after advancing of shield supports 24.

INDUSTRIAL APPLICABILITY

In the following, a control method for controlling shearer 10 is described with reference to FIGS. 1 to 10. Said control method may facilitate a reduction in required operator assistance for operating shearer 10.

Figure 2:
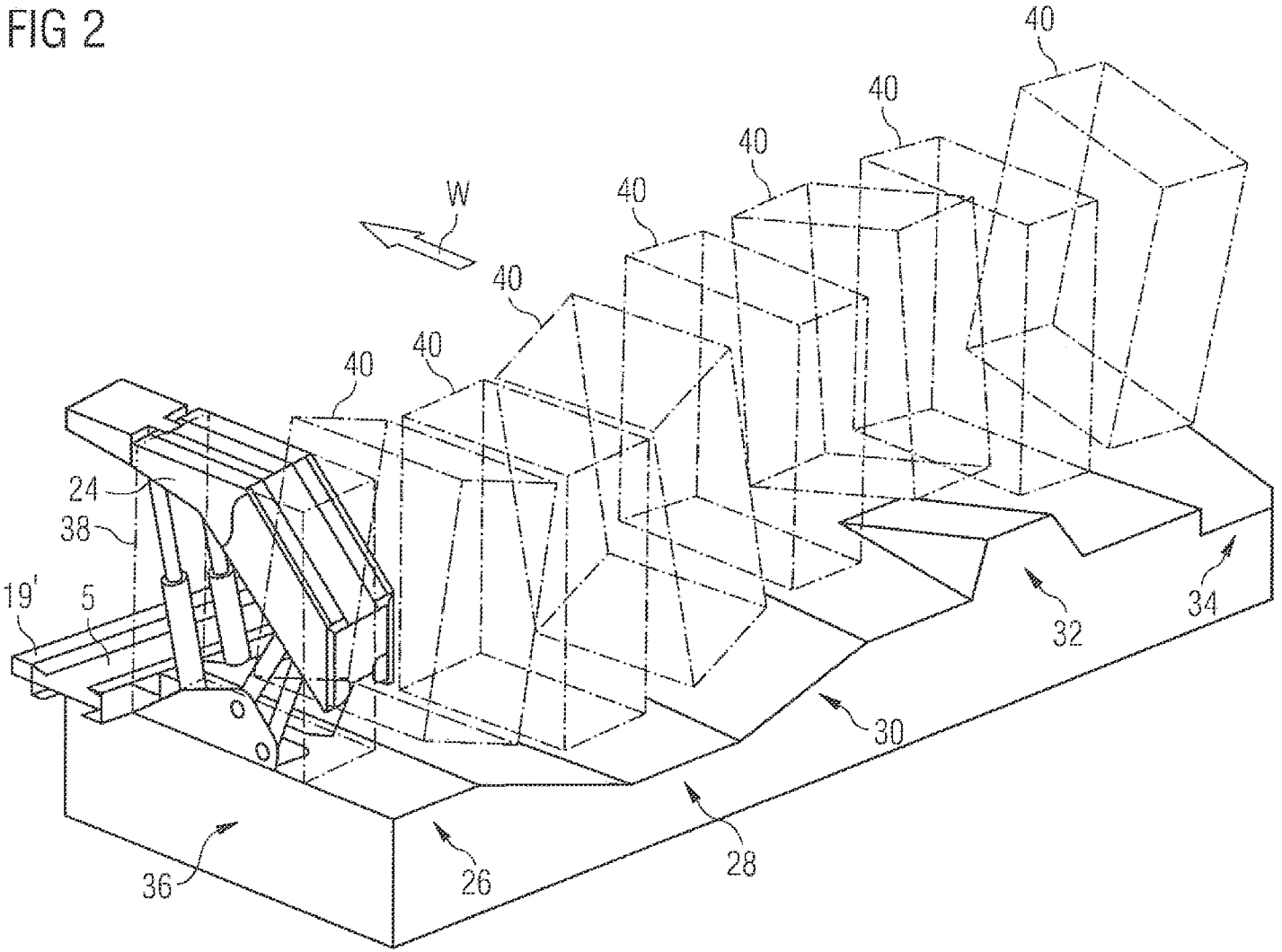
FIG. 2 is an illustrative drawing of a face conveyor and a shield support.
Figure 3:
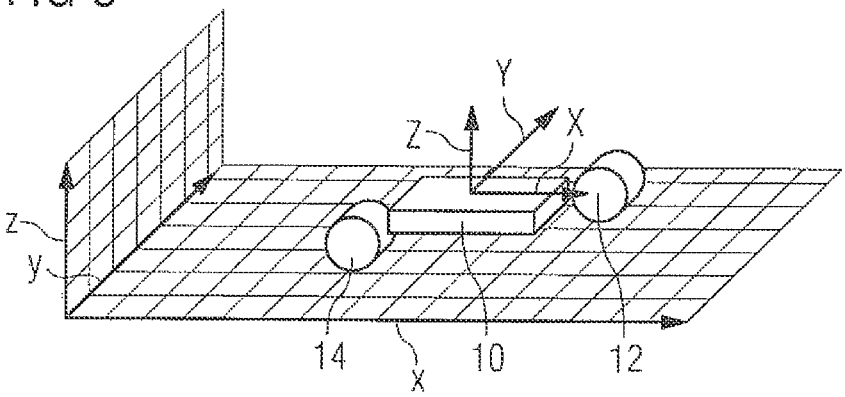
FIG. 3 is a schematic drawing illustrating two coordinate systems for describing shearer positions.

Firstly, to ease understanding of the method for controlling shearer 10 disclosed herein, FIG. 2 illustrates the influence of the bottom floor constitution on the mining equipment extending along longwall face 2. For clarification, the illustrated variations of the bottom floor constitution are overemphasized.

As exemplary shown, the bottom floor constitution in an underground mine 1 varies. For example, humps (indicated with reference signs 26, 28), swilleys (indicated with reference sign 30), inclinations (indicated with reference signs 32, 34) may be present side-by-side forming a bottom floor 36 for the mining equipment. Mining equipment as used herein particularly refers to face conveyor segments 5, shearer 10 and shield supports 24.

As already described in connection with FIG. 1, shield supports 24, face conveyor segments 5, and shearer 10 (not shown in FIG. 2 for clarification) are arranged on bottom floor 36. A dashed box 38 is drawn around shield support 24 to indicate position and orientation of the same. Dashed boxes 40 are representative of further shield supports 24 and face conveyor segments 5 to illustrate the influence of the bottom floor constitution on the positions and orientations of the mining equipment.

Again, it is noted that although not depicted in FIG. 2, shearer 10 is carried by face conveyor segments 5. Specifically, each face conveyor segment 5 includes a shearer rail segment 19' at a longitudinal side of face conveyor segment 5 facing longwall face 2. By adjacently positioning and connecting face conveyor segments 5 in a row, also a shearer guiding rail 19 is formed (see FIG. 1). Said shearer guiding rail 19 is formed by connection of individual shearer rail segments 19' for guiding and carrying shearer 10. Consequently, position and orientation of face conveyor segments 5 directly influence position and orientation of shearer 10.

Taking a closer look on boxes 38, 40, it is apparent that positions and orientations of mining equipment along the longwall face vary along the six degrees of freedom in a very broad range. Those six degrees of freedom are lateral, longitudinal, vertical, roll, pitch and yaw.

Furthermore, during operation, mining equipment advances in work direction (arrow W) to follow successively cutted longwall face 2. As a result of the advancing step, positions and orientations of mining equipment are differing after each advancing step. Advancing may be performed in accordance with a plurality of preset lengths of step moving devices of shield supports 24. Due to the influence of the bottom floor constitution, it is not foreseeable how the position and orientation of the mining equipment thereby changes.

In the following, when describing positions and orientations of shearer 10, basically two coordinate systems are used. Those two coordinate systems are introduced in FIG. 3. A first coordinate system with x-, y-, and z-axis and a second coordinate system with X-, Y- and Z-axis are shown. First coordinate system x, y, z (also referred to as navigation frame) is a local coordinate system that is independent of shearer 10, whereas second coordinate system X, Y, Z (also referred to as shearer body frame) is a local coordinate system that is dependent on shearer 10. In other words, a movement of shearer 10 along longwall face 2 varies a shearer position expressed in coordinates of navigation frame x, y, z, whereas the shearer position expressed in coordinates of shearer body frame X, Y, Z do not vary as shearer body frame X, Y, Z moves with shearer 10. Exemplary, point of origin of navigation frame x, y, z may be located in roadway 20 (see FIG. 1) and point of origin of the shearer body frame X, Y, Z may be located on shearer 10.

For example, y-axis points in direction of the work direction (arrow W in FIGS. 1 and 2), and shearer 10 travels along longwall face 2 parallel to the x-axis if abstracting away from direction changes due to, for example, varying bottom floor constitutions as already described in connection with FIG. 2.

Naturally, coordinates of navigation frame x, y, z can be transformed to coordinates of shearer body frame X, Y, Z by spatial transformation, and vice versa, if the relationship between both is known. In other words, position and orientation of shearer body frame X, Y, Z within navigation frame x, y, z have to be known or determined. Note that to control drum height positions of the first cutting drum 12 and the second cutting drum 14, coordinates have to be given in shearer body frame X, Y, Z.

Figure 4:
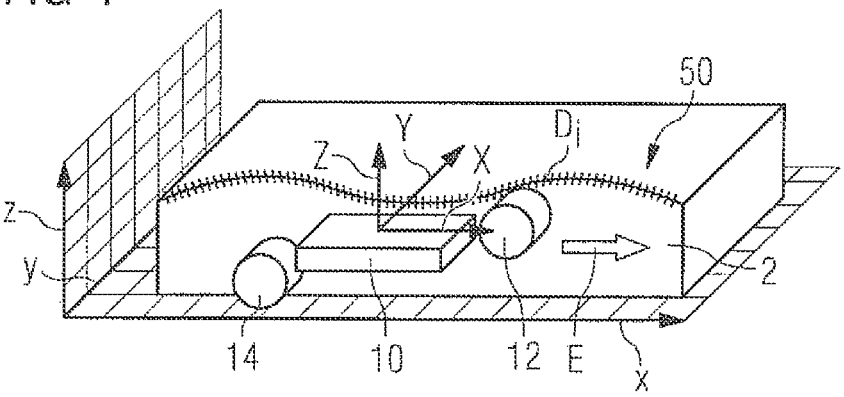
FIG. 4 is schematic drawing showing a shearer travelling and cutting along a longwall face.

Referring to FIG. 4, a method for operating shearer 10 comprises setting a first cutting profile 50 including a plurality of desired positions $D_i$ to be approached by first cutting drum 12 in the first travel direction E along longwall face 2 to extract material. The quantity of desired drum positions $D_i$ may be chosen depending on a length of longwall face 2. For example, i may be within a range from 0 to 10,000 which means that 10,000 desired drum positions $D_i$ to be approached by first cutting drum 12 in first cutting direction E are set in first cutting profile 50.

Setting of first cutting profile 50 may be performed, for example, by an operator being present in underground mine 1 for teach-in programming of shearer 10 which is characterized by the operator directly teaching to be approached desired drum positions $D_i$ for first cutting drum 12 and/or second cutting drum 14.

In the embodiment shown in FIG. 4, first cutting profile 50 includes desired drum positions $D_i$ to be approached by first cutting drum 12 which is the so-called leading cutting drum in first travel direction E. Alternatively, first cutting profile 50 may be set for the so-called trailing cutting drum in first travel direction E, namely second cutting drum 14, or for both first cutting drum 12 and second cutting drum 14.

In some embodiments, first cutting profile 50 comprises desired drum positions $D_i$ to be approached by first cutting drum 12 and second cutting drum 14 in first travel direction E of the shearer 10. Specifically, a first cutting profile 50 may comprise a roof cutting profile which includes desired drum positions $D_i$ to be approached by first cutting drum 12, and a floor cutting profile which includes desired drum positions $D_i$ to be approached by second cutting drum 14.

The method for operating shearer 10 may further comprise advancing shearer 10 towards longwall face 2 (in working direction as indicated by arrow W in FIGS. 1 and 2). Although not individually depicted, the method step of advancing shearer 10 is timely performed after the situation shown in FIG. 4 and before the situation shown in FIG. 5.

Advancing of shearer 10 comprises advancing of face conveyor 4 and shield supports 24 already described in connection with FIG. 1. As a result of advancing face conveyor 4 towards longwall face 2, shearer guiding rail segments 19' changes position and orientation depending on the bottom floor constitution as already described in connection with FIG. 2.

The method further comprises determining a plurality of actual advancing vectors $v_i$ at face conveyor 4 along longwall face 2. Each actual advancing vectors $v_i$ indicating a change of the shearer position resulting from advancing shearer 10 towards longwall face 2 and the influence of the bottom floor constitution. Note that due to the influence of the bottom floor constitution (humps, swilleys, inclinations), actual advancing vectors $v_i$ differ from one another along longwall face 2.

The method further comprises determining a plurality of shearer orientations $O_i$ (not shown) at face conveyor 4 along longwall face 2 resulting from advancing shearer 10 towards longwall face 2 and the influence of the bottom floor constitution. Again, note that due to the influence of the bottom floor constitution (humps, swilleys, inclinations), shearer orientations $O_i$ differ from one another along longwall face 2.

Measuring of the plurality of actual advancing vectors $v_i$ and the plurality of shearer orientations $O_i$ may be performed prior starting travel of shearer 10 in second travel direction F, and/or during travel of shearer 10 in second travel direction F.

To measure positions and orientations during travelling in second travel direction F, shearer 10 may be equipped with respective position and orientation measuring devices such as inertial measurement device 18 and/or inclinometer 16 (see FIG. 1).

Alternatively or additionally, the plurality of actual advancing vectors $v_i$ and the plurality of shearer orientations $O_i$ may be measured after advancing face conveyor 4 towards longwall face 2 and before shearer 10 actually reaches (passes) the respective measurement location at face conveyor 4 for determining actual advancing vectors $v_i$ and shearer orientations $O_i$. For example, a plurality of position and orientation measuring devices may be arranged along face conveyor 4, and/or an individual measurement device may be configured to move along face conveyor 4 independent of shearer 10 to perform position and orientation measurements at a plurality of locations at face conveyor 4 along longwall face 2.

Figure 5:
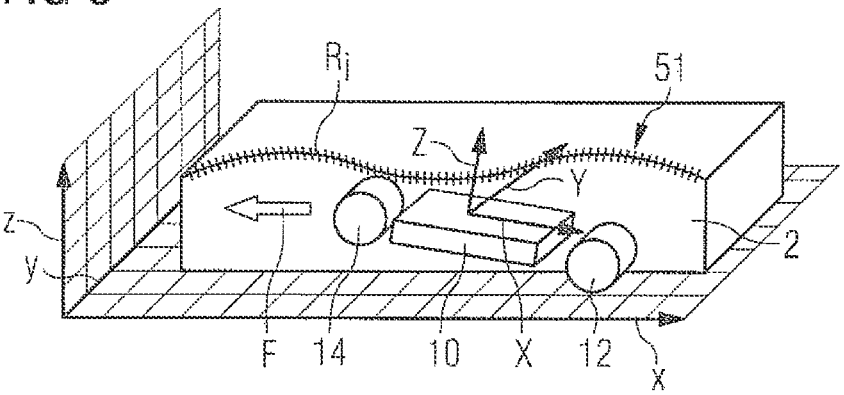
FIG. 5 is schematic drawing showing a shearer travelling and cutting along a longwall face.

Referring to FIG. 5, the method further comprises generating a second cutting profile including a plurality of desired positions $R_i$ to be approached by at least one of first cutting drum 12 and second cutting drum 14 in second travel direction F opposing first travel direction E of shearer 10 based on set first cutting profile 50, the plurality of actual advancing vectors $v_i$ and the plurality of shearer orientations $O_i$. At least one of first cutting drum 12 and second cutting drum 14 are controlled based on the generated second cutting profile 51 while moving shearer 10 in second travel direction F along longwall face 2. In the shown embodiment of FIG. 5, second cutting drum 14 which is the leading drum in the second cutting direction F, is controlled based on the generated second cutting profile 51.

Hereinafter, generation of second cutting profile 51 is exemplary explained for a single drum position with reference to FIGS. 6 to 9. Dimensions and distances are over-emphasized for clarification.

Figure 6:
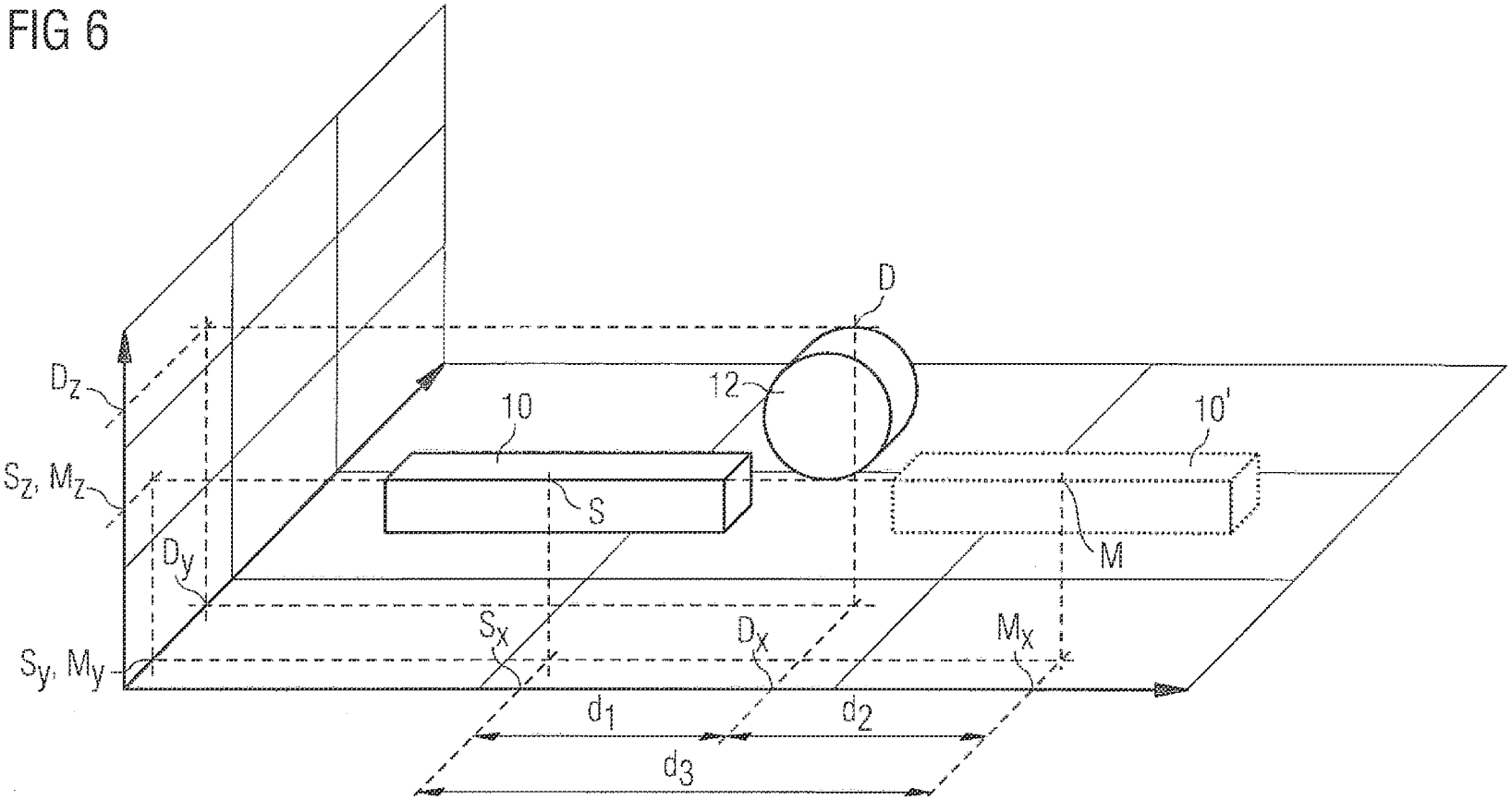
FIG. 6 is a schematic drawing illustrating an exemplary method step for controlling the shearer.

In FIG. 6, a shearer position S indicates a position of shearer 10 with first cutting drum 12 at a drum position D. For ease of description, a second cutting drum 14 of shearer 10 is not shown. Drum position D of first cutting drum 12 is one of the plurality of desired positions $D_i$ of the first cutting profile 50 (see FIG. 4), which is currently set, for example, during teach-in programming by an operator. Additionally, shearer position S is one of a plurality of shearer positions $S_i$ which may be also part of first cutting profile 50.

A distance $d_1$ indicates a distance along the x-axis from shearer position S to (desired) drum position D. A distance $d_3$ is twice the distance $d_2$. A mirror shearer position M is generated in distance $d_3$ from shearer position S in direction of the first travel direction E, namely along the x-axis. At mirror shearer position M, a mirror shearer 10' is generated.

Figure 7:
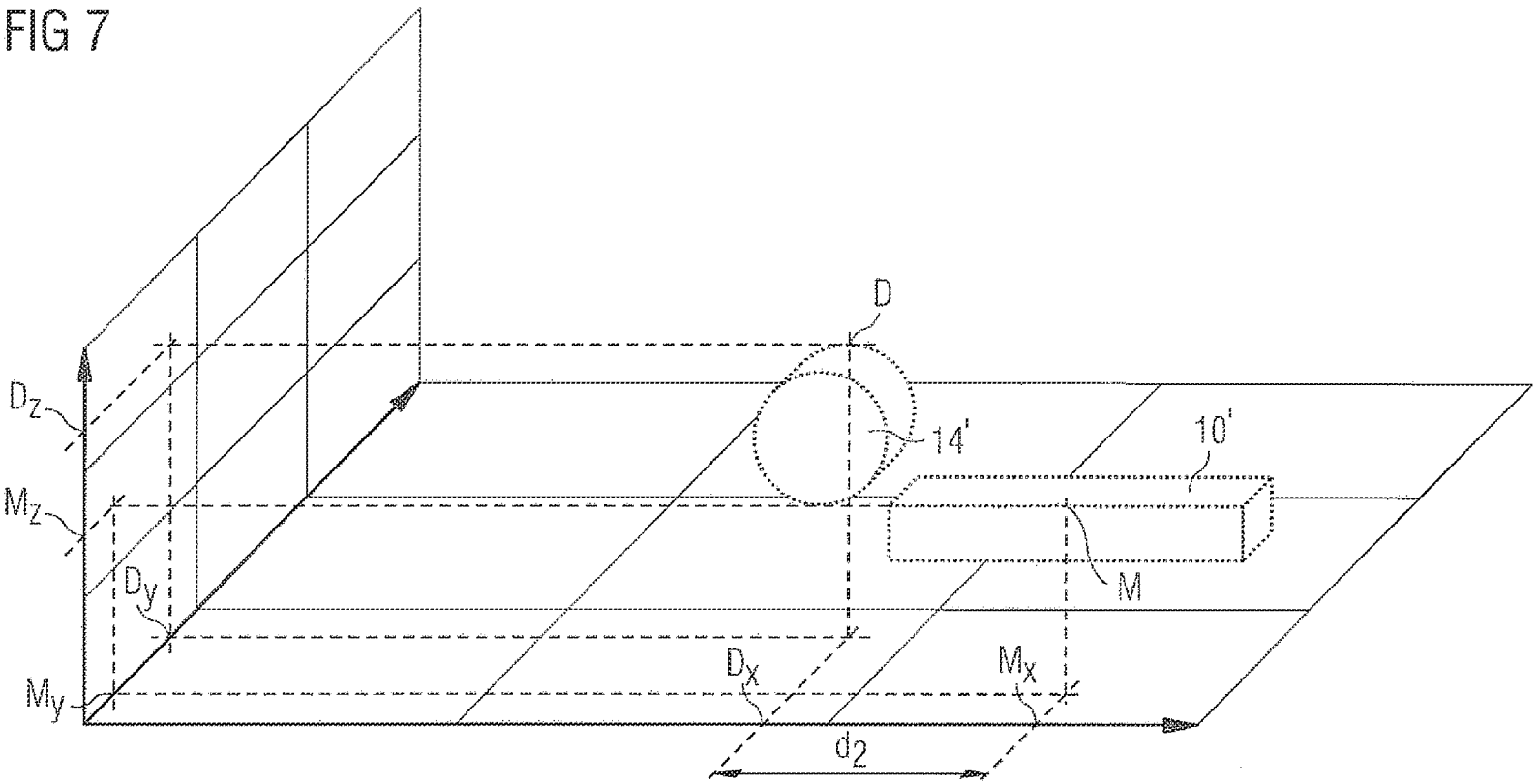
FIG. 7 is a schematic drawing illustrating another exemplary method step for controlling the shearer.

Turning to FIG. 7, mirror shearer 10' at mirror shearer position M is depicted as in FIG. 6. A cutting drum position D indicates a position of a second mirror cutting drum 14' of mirror shearer 10' at mirror shearer position M. A distance $d_2$ indicates a distance along the x-axis from drum position D to mirror shearer position M. As distance $d_3$ is twice distance $d_1$, distance $d_2$ is equal to distance $d_1$ as shown in FIG. 6. Drum position D can be regarded as a common drum position for first cutting drum 12 of shearer 10 moving in first travel direction E (shown in FIG. 6) and a second mirror cutting drum 14' of mirror shearer 10' moving in second travel direction F (shown in FIGS. 6 to 9). In other words, mirror shearer 10' can be regarded as a model which would reach with second mirror cutting drum 14' the same drum position D as shearer 10 with first cutting drum 12 if controlling a drum height of second mirror cutting drum 14' similar to a drum height of first cutting drum 12.

Figure 8:
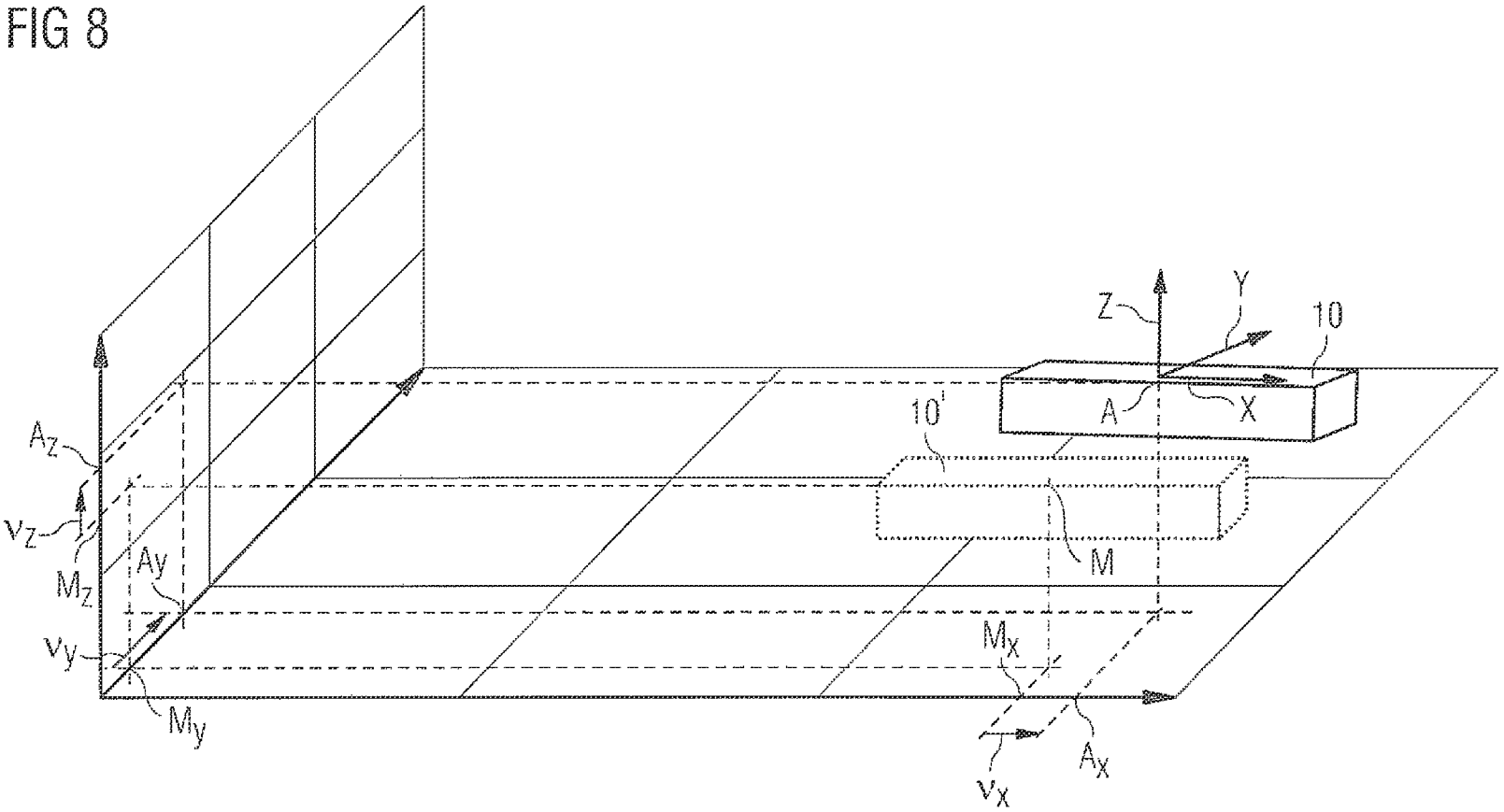
FIG. 8 is a schematic drawing illustrating yet another exemplary method step for controlling the shearer.

Referring now to FIG. 8 showing a situation after advancing of the longwall mining equipment (towards longwall face 2), namely in direction of the y-axis. An advanced shearer position A indicates a position of shearer 10. Advanced shearer position A is measured at the same location of face conveyor 4 (see, for example, FIG. 1) at which mirror shearer position M with mirror shearer 10' was mirrored.

An actual advancing vector v, which is one of the plurality of advancing vectors $v_i$ already referred to, is determined. As depicted, v includes three components, namely $v_x$, $v_y$, and $v_z$. As exemplary depicted, despite the fact that mirror shearer position M and advanced shearer position A are located at the same location of face conveyor 4, $v_z$ is not zero due to the influence of the bottom floor constitution as described in connection with FIG. 2. Moreover, in the shown example, $v_x$, and $v_y$ are non-zero which may be a result of a bottom floor hump or inclination on which the longwall equipment climbed during the advancing step. In other words, the plurality of actual advancing vectors $v_i$ is based for each of the plurality of actual advancing vectors $v_i$ on an absolute position change of shearer 10 from a shearer position $S_i$ before advancing shearer 10 to an advanced shearer position $A_i$ after advancing shearer 10 towards longwall face 2.

Although not explicitly shown, an actual shearer orientation O of shearer body frame X, Y, Z is determined at advanced shearer position A. As an example, a pitch and a yaw of shearer 10 are determined at advanced shearer position A. Actual shearer orientation O is one of the plurality of actual shearer orientations $O_i$ already referred to.

Figure 9:
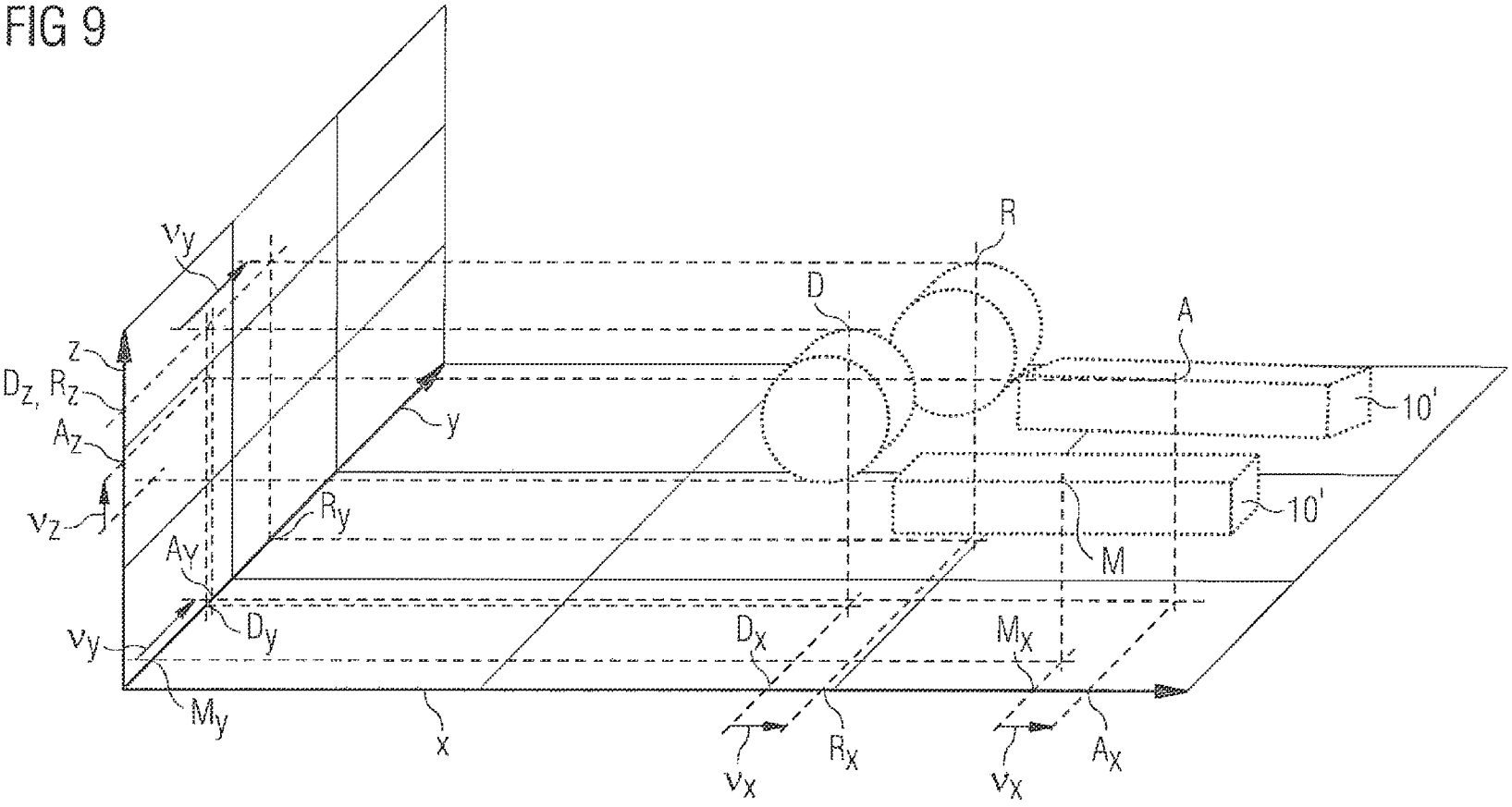
FIG. 9 is a schematic drawing illustrating a further exemplary method step for controlling the shearer.

Turning to FIG. 9, a model is shown in which control data was already generated based on actual shearer orientation O, actual advancing vector v, drum position D and shearer position S.

In a first step, a desired drum position R to be exemplary approached by second cutting drum 14 during travel of shearer 10 in the second travel direction F was determined. As indicated, desired drum position R was determined based on drum position D plus actual advancing vector $v_i$ and a substitution of the resulting height value (along the z-axis) with the initially determined height value $D_z$ of drum position D to maintain the desired cutting profile height.

The generated desired drum position R can now be spatially transformed into shearer body frame X, Y, Z (see, for example, FIG. 3) by using the determined shearer orientation O to facilitate control of cutting drum height of second cutting drum 14 of shearer 10 during travel in second travel direction F at the specific location i at face conveyor 4.

The above exemplary described generation of desired drum positions $R_i$ of second cutting profile 51 may be applied for a plurality of locations i along face conveyor 4. Moreover, not only desired drum positions $R_i$ of second cutting drum 14 may be generated, but also desired drum positions $R_i$ of first cutting drum 12 in second cutting profile may be generated analogous. The described method may be applied for roof cutting and/or floor cutting.

Further, additional parameters may be included in the generation of second cutting profile 51 such as a plurality of preset cutting height offsets $P_i$ to follow a seam gradient and/or to follow varying seam thicknesses more accurately.

Second cutting profile 51 may be the basis for generating a new first cutting profile to control cutting drums 12 and/or 14 of shearer 10 during travel in first travel direction E after a further advancing towards longwall face 2, and so on after each subsequent pass of shearer 10. Each new generated cutting profile may not only be based on the last cutting profile, but also on further already cutted cutting profiles which were stored after generating the same. In this respect, it may be possible to derive floor gradient trends and/or roof gradient trends which may be incorporated when generating new cutting profiles.

Cutting profiles may be organized in form of 2D-maps. For example, a cutting profile may include data for first cutting drum 12 and second cutting drum 14 in one travel direction of shearer 10 along longwall face 2. As an alternate example, a cutting profile may be applied for each cutting drum and travel direction such that one cutting profile represents a cutting profile of first cutting drum 12 in first travel direction E etc.

The method step of controlling first cutting drum 12 and/or second cutting drum 14 in the second travel direction F may further comprise measuring an actual drum position deviation $G_i$ from the desired drum position $R_i$ of the second cutting profile 51, and adjusting an actual shearer travel speed of shearer 10 in second travel direction F based on the measured actual drum position deviation $G_i$. For example, a threshold deviation T may be preset, and in case the measured actual drum position deviation $G_i$ is greater than the preset threshold deviation T, a shearer travel speed may be reduced to allow adjusting of a cutting drum height of first cutting drum 12 or second cutting drum 14.

A further advantage of automatically generating cutting profile may be minimization of floor variations between individual advancing steps. In case the control method disclosed herein is used for floor cutting operations, the above described generation of cutting profiles may further reduce the variations of the bottom floor constitution (see FIG. 2) for the next advancing steps, which may improve the extraction process.

Although the preferred embodiments of this invention have been described herein, improvements and modifications may be incorporated without departing from the scope of the following claims.

The invention claimed is:

1. A method for controlling a shearer configured to travel along a longwall face in an underground mine in a first travel direction (E) and a second travel direction (F) to extract material with a first cutting drum and a second cutting drum, the method comprising steps of:

setting a first cutting profile including a plurality of desired positions ($D_i$) to be approached by the first cutting drum in the first travel direction (E);

advancing the shearer toward the longwall face;

determining a plurality of actual advancing vectors ($v_i$) along the longwall face, each actual advancing vector ($v_i$) indicating a change of a position of the shearer resulting from advancing the shearer;

determining a plurality of shearer orientations ($O_i$) along the longwall face resulting from advancing the shearer; and generating a second cutting profile including a plurality of desired positions ($R_i$) to be approached by at least one of the first cutting drum and the second cutting drum in the second travel direction (F) of the shearer based on the first cutting profile, the plurality of actual advancing vectors ($v_i$), and the plurality of shearer orientations ($O_i$), the second travel direction (F) being opposite the first travel direction (E).

2. The method of claim 1, further comprising controlling at least one of the first cutting drum and the second cutting drum based on the generated second cutting profile while moving the shearer in the second travel direction (F) along the longwall face.

3. The method of claim 2, wherein controlling at least one of the first cutting drum and the second cutting drum in the second travel direction (F) comprises:

measuring an actual drum position deviation ($G_i$) from a desired position ($R_i$) of the second cutting profile selected from the desired positions (Ri); and adjusting an actual travel speed of the shearer in the second travel direction (F) based on the measured actual drum position deviation ($G_i$).

4. The method of claim 1, wherein the first cutting profile further includes a plurality of desired positions ($D_i$) to be approached by the second cutting drum in the first travel direction (E).

5. The method of claim 1, wherein the plurality of actual advancing vectors ($v_i$), and the plurality of shearer orientations ($O_i$) are determined based on measurements of an inertial measurement device.

6. The method of claim 1, wherein the plurality of actual advancing vectors ($v_i$), and the plurality of shearer orientations ($O_i$) are based on measurements of an inclinometer.

7. The method of claim 1, wherein advancing the shearer toward the longwall face comprises advancing a plurality of face conveyor segments having a shearer guiding rail toward the longwall face.

8. The method of claim 1, wherein the first cutting profile is received from an operator by teach-in programming.

9. The method of claim 1, wherein each shearer orientation of the plurality of shearer orientations ($O_i$) is used for spatial transformation of position information between a first coordinate system (x, y, z) that is a local coordinate system independent of the shearer, and a second coordinate system (X, Y, Z) that is a local coordinate system dependent on the shearer.

10. The method of claim 1, wherein the generated second cutting profile is used as a basis for generating a new first cutting profile.

11. The method of claim 1, wherein generating the second cutting profile is further based on a plurality of preset cutting height offsets along the longwall face.

12. The method of claim 1, wherein at least two of the steps at least partially overlap in time.

13. A shearer configured to be carried by a face conveyor extending along a longwall face in an underground mine, the shearer comprising:

a main body having a first end and a second end opposing the first end;

a first cutting drum pivotably mounted to the first end of the main body to vary a cutting drum height of the first cutting drum;

a second cutting drum pivotably mounted to the second end of the main body to vary a cutting drum height of the second cutting drum;

a device configured to measure a position and an orientation of the shearer; and a control unit configured to:

set a first cutting profile including a plurality of desired positions ($D_i$) to be approached by the first cutting drum in a first travel direction (E);

advance the shearer toward the longwall face;

generate a second cutting profile based on information received from the device the second cutting profile to be approached by the first cutting drum and the second cutting drum in a second travel direction (F) along the longwall face, the second travel direction (F) being opposite the first travel direction (E);

control the cutting drum height of the first cutting drum based on the second cutting profile; and control the cutting drum height of the second cutting drum based on the second cutting profile.

14. The shearer of claim 13, wherein the device comprises an inertial measurement device.

15. The shearer of claim 13, wherein the device comprises an inclinometer.

16. The shearer of claim 13, wherein the control unit is further configured to:

determine a plurality of actual advancing vectors ($v_i$) along the longwall face, each actual advancing vector ($v_i$) indicating a change of the position of the shearer resulting from advancing the shearer; and determine a plurality of shearer orientations ($O_i$) along the longwall face resulting from advancing the shearer, wherein the second cutting profile includes a plurality of desired positions ($R_i$) to be approached by at least one of the first cutting drum and the second cutting drum in the second travel direction (F) of the shearer based on the first cutting profile, the plurality of actual advancing vectors ($v_i$), and the plurality of shearer orientations ($O_i$).

17. The shearer of claim 16, wherein the control unit is configured to spatially transform position information between a first coordinate system (x, y, z) that is a local coordinate system independent of the shearer, and a second coordinate system (X, Y, Z) that is a local coordinate system dependent on the shearer based on the shearer orientations ($O_i$).

18. The shearer of claim 17, wherein the control unit is further configured to:

measure an actual drum position deviation ($G_i$) from a desired position ($R_i$) of the second cutting profile selected from the desired positions (Ri); and adjust an actual travel speed of the shearer in the second travel direction (F) based on the measured actual drum position deviation ($G_i$).

19. The shearer of claim 13 further comprising:

a plurality of face conveyor segments; and a shearer guiding rail attached to each of the face conveyor segments, wherein the control unit is further configured to advance the face conveyor segments toward the longwall face.

* * * * *